US007472698B1

(12) United States Patent
Anibas

(10) Patent No.: US 7,472,698 B1
(45) Date of Patent: Jan. 6, 2009

(54) ENERGY SAVING COOK-TOP REFLECTOR ASSEMBLY

(76) Inventor: Kevin J. Anibas, 2136 4th St., Eau Claire, WI (US) 54703

( * ) Notice: Subject to any disclaimer, the term of this patent is extended or adjusted under 35 U.S.C. 154(b) by 463 days.

(21) Appl. No.: 11/408,295

(22) Filed: Apr. 24, 2006

(51) Int. Cl.
*A01H 5/02* (2006.01)
*F24B 5/08* (2006.01)
*F24C 15/08* (2006.01)

(52) U.S. Cl. ..... 126/1 R; 126/214 D; 126/9 R; 126/216; 219/452.11; 219/455.11; 219/455.12

(58) Field of Classification Search ..... 126/1 R, 126/9 R, 9 B, 24, 39 B, 39 M, 39 R, 40, 152 B, 126/153, 154, 211, 214 D, 215, 216, 400; 219/385, 386, 390, 443.1, 451.1, 452.11, 219/455.11, 455.12, 456.1, 481, 521, 534, 219/535; 7/109; D7/323, 339, 346, 347, D7/412

See application file for complete search history.

(56) References Cited

U.S. PATENT DOCUMENTS 178,145 A * 5/1876 Hauck ..... 220/4.03
1,367,333 A * 2/1921 Truesdell ..... 126/215
1,497,643 A * 6/1924 Rutkowski ..... 126/211
1,592,729 A * 7/1926 Feist ..... 126/214 D
2,025,252 A * 12/1935 Stencell ..... 219/418
2,797,298 A * 6/1957 Fujitani ..... 219/443.1
3,583,384 A 6/1971 Ranisate
3,916,872 A * 11/1975 Kreis et al. ..... 126/375.1
3,960,134 A 6/1976 Scott
4,009,795 A 3/1977 Hurko et al.
4,108,140 A 8/1978 Wolze
4,296,728 A 10/1981 Hofstetter
4,313,050 A 1/1982 Abenaim
4,337,752 A 7/1982 Leounes
4,448,186 A 5/1984 Smith
5,638,806 A 6/1997 Foust
5,910,265 A * 6/1999 Baker et al. ..... 219/451.1
5,951,899 A * 9/1999 Eichler et al. ..... 219/451.1
6,078,029 A * 6/2000 Trujillo et al. ..... 219/415
6,593,550 B1 7/2003 Royer

* cited by examiner

*Primary Examiner*—George Nguyen
*Assistant Examiner*—Daniel E Namay
(74) *Attorney, Agent, or Firm*—Tipton L. Randall

(57) ABSTRACT

An energy saving reflector assembly for cook-top heating units. The reflector assembly features a device which concentrates heat on the bottom of a cooking vessel being heated and prevents heat from escaping laterally from under the vessel being heated. The device provides significant decreases in both cooking time and energy consumption. Embodiments for electric and gas cook-tops are described.

21 Claims, 6 Drawing Sheets

ENERGY SAVING COOK-TOP REFLECTOR ASSEMBLY

CROSS-REFERENCE TO RELATED APPLICATIONS, IF ANY

Not Applicable.

STATEMENT REGARDING FEDERALLY SPONSORED RESEARCH OR DEVELOPMENT

Not Applicable.

REFERENCE TO MICROFICHE APPENDIX, IF ANY

Not Applicable.

BACKGROUND OF THE INVENTION

1. Field of the Invention

The present invention is a cook-top reflector assembly, featuring a device that concentrates heat on the bottom of a cooking vessel being heated and prevents heat from escaping laterally from under the vessel being heated.

2. Background Information

The invention is a range cook-top reflector assembly, featuring a spring-biased reflector cylinder that mates to cooking vessels placed on the cook-top burner and prevents heat from escaping laterally from under the vessel. The result is decreased energy consumption and cooking time.

Experimentation has indicated that significant quantities of heat energy are wasted on currently available conventional range cook-tops. The heat is wasted as it escapes laterally from under a vessel being heated. Cooking time is also increased, because the vessel and its contents are not heated as efficiently as they might be. Additionally, the waste heat increases the room temperature, which can increase the use of air conditioning, a further consumption of energy.

A variety of devices have been disclosed that improve utilization of heat energy for range cook-tops. Patents have been granted for some of the devices, including the following. U.S. Pat. No. 3,583,384 by Ranisate; U.S. Pat. No. 3,960,134 by Scott; U.S. Pat. No. 4,009,795 by Hurko et al.; U.S. Pat. No. 4,108,140 by Wolze; U.S. Pat. No. 4,296,728 by Hofstetter; U.S. Pat. No. 4,313,050 by Abenaim; U.S. Pat. No. 4,337,752 by Leounes; U.S. Pat. No. 4,448,186 by Smith; U.S. Pat. No. 5,638,806 by Foust and U.S. Pat. No. 6,593,550 by Royer.

Applicant has invented a range cook-top reflector assembly, which directs heat at the bottom of the vessel being heated and prevents heat from escaping laterally from under the vessel being heated. The device works with any size vessel, but functions most efficiently with a vessel properly sized for the burner. The invention may be easily retrofitted to currently produced electric and gas ranges. In the case of electric ranges with plug-in heating elements, one embodiment of the invention replaces the standard cook-top reflector pans. In the case of gas ranges, another embodiment of the invention replaces the standard cook-top burner grates.

SUMMARY OF THE INVENTION

The invention is a range cook-top reflector assembly, which prevents heat from escaping laterally from under a vessel being heated. The reflector assembly features a spring-biased reflector cylinder member, which mates to the bottom of a cooking vessel placed on a gas burner or electric heating element. The reflector cylinder member prevents heat from escaping laterally, and concentrates heat on the bottom of the vessel. The biasing springs provide just enough force to lift the reflector cylinder member to its highest position and are easily overcome by even the lightest common cooking vessel. The invention is applicable to conventional electric and gas cook-tops and is easily retrofitted to both types of appliances.

Broadly, the energy-saving reflector assembly, adapted for improved heating of a cooking vessel by a heat source on a range cook-top, includes a housing member operatively associated with said heat source. A reflector cylinder member of selected diameter has an open top end with a top edge, an open bottom end with a bottom edge, and a cylindrical sidewall. The reflector cylinder member is biased mounted within the housing member and encircles the heat source operatively associated with the housing member. The top edge of the reflector cylinder member extends above the housing member and is adapted for encircling the cooking vessel of diameter less than the selected diameter of the cylinder member with the cooking vessel positioned within the reflector cylinder member. The top edge of the reflector cylinder member retracts into the housing member by contact with the cooking vessel of a diameter at least equal to the selected diameter of the reflector cylinder member.

In one embodiment, the housing member comprises a grate member operatively associated with a gas burner heat source. The grate member includes a plurality of vertical mounting slots housing the reflector cylinder member therein.

In another embodiment, the housing member comprises a trim ring member rigidly fastened to a reflector pan member with a concentric circular aperture there between, with the aperture housing the reflector cylinder member. The trim ring member and the attached reflector pan member are operatively associated with an electrical heating element coil member heat source.

As illustrated in FIGS. 9, 10 and 11, the invention functions with any reasonably sized cooking vessel. A cooking vessel of the correct size for a coil heating element, as shown in FIG. 9, is heated most efficiently when in full contact with the coil heating element for conductive heat transfer, and is completely sealed by the reflector cylinder member for reflected radiant and convective heat transfer. A cooking vessel too small for the heating element, as shown in FIG. 10, benefits from the reflector cylinder providing increased reflected radiant heating, as well as from having convective heat held closer to the vessel. A cooking vessel which is marginally too large for the coil heating element, as illustrated in FIG. 11, benefits from increased reflected radiant heating and from convective heating, as the reflector cylinder member seals against the bottom of the vessel and prevents lateral heat loss. FIGS. 12 and 13 illustrate the invention in use with a cooking vessel that is far too large for the coil heating element. In this situation, the reflector cylinder member can be latched into a fully retracted position so that the coil heating element operates in the same fashion as it would without the invention in place. While FIGS. 9-13 show only the electric range embodiment of the invention, the gas range embodiment, shown in FIGS. 5-8, functions in the same manner.

NOMENCLATURE

Figure 1:
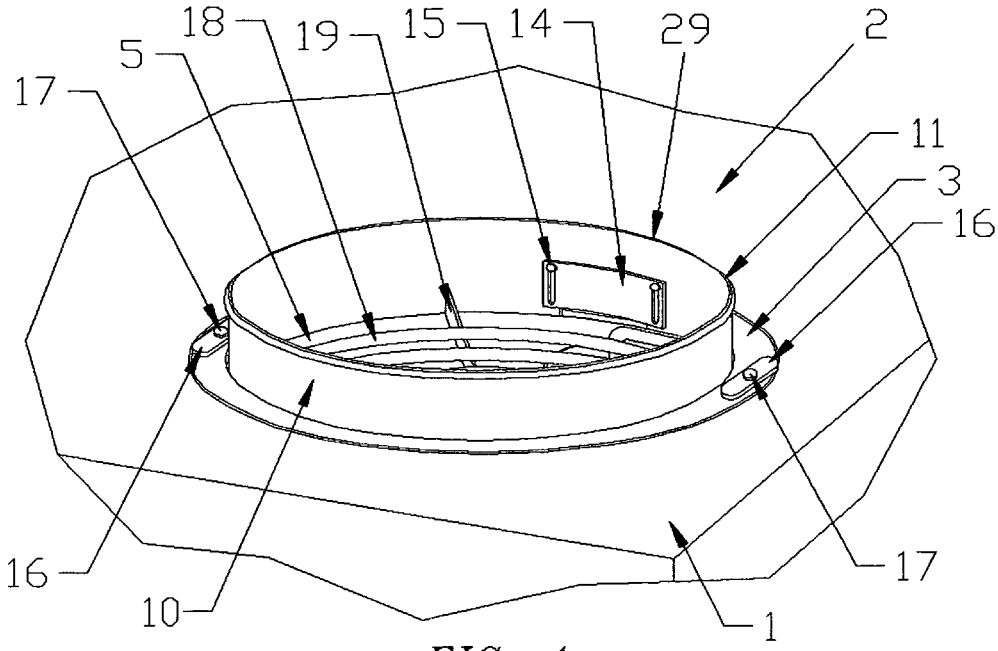
FIG. 1 is a perspective view of the electric range embodiment of the invention in place on a cook-top.
Figure 2:
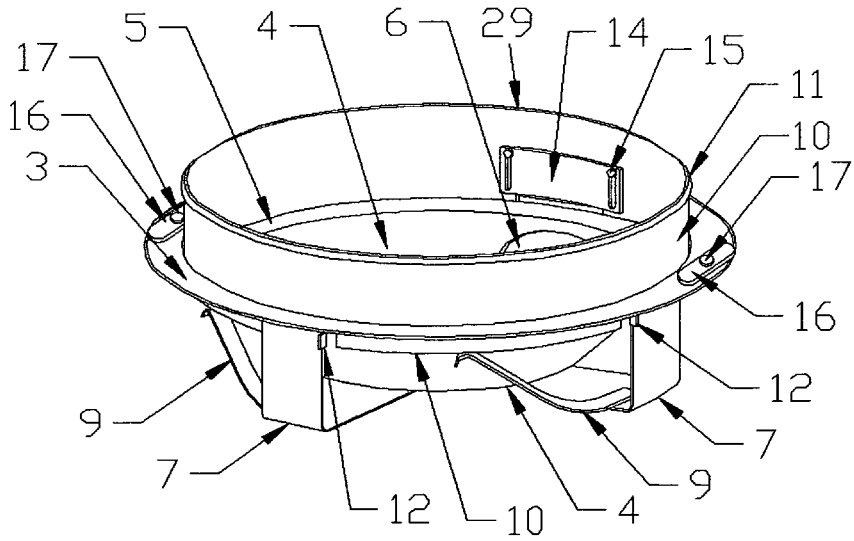
FIG. 2 is a perspective view of the electric range embodiment of the invention.
Figure 3:
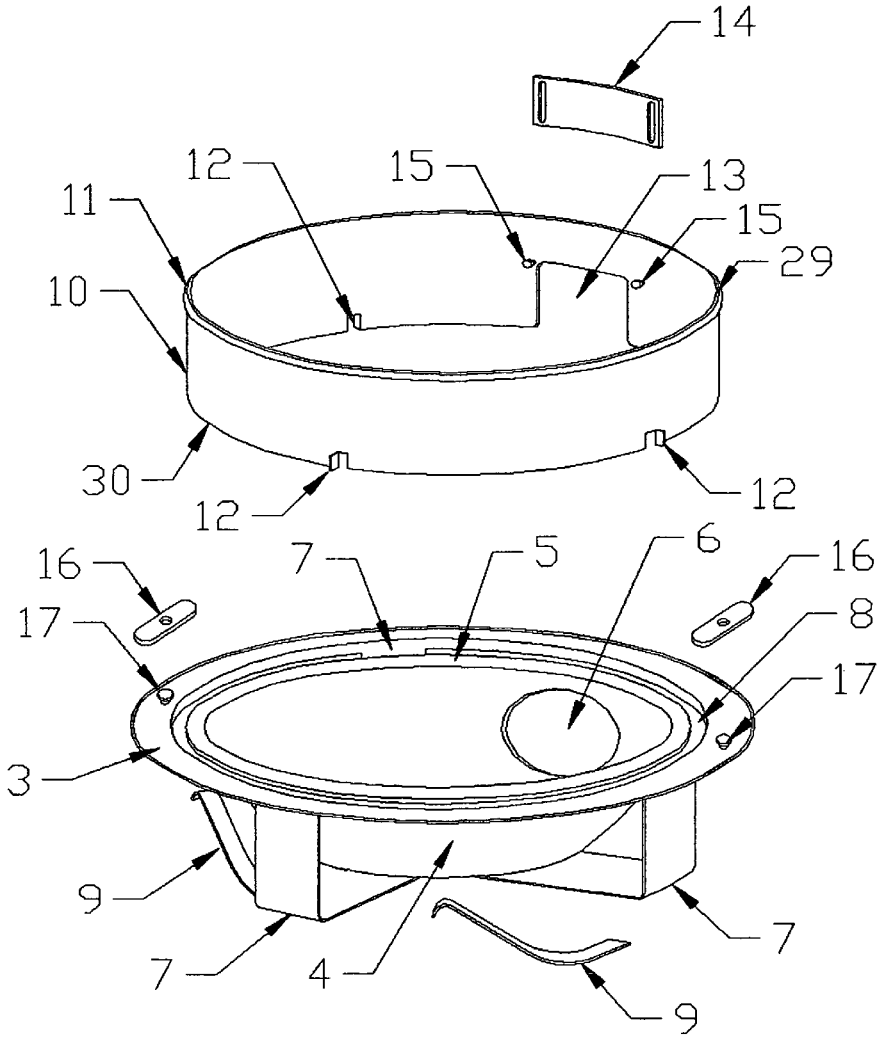
FIG. 3 is an exploded perspective view of the electric range embodiment of the invention.

1 Cook-top
2 Reflector Assembly for Plug-in Element Electric Ranges
3 Trim Ring Member
4 Reflector Pan Member
5 Reflector Pan Flange
6 Electric Element Plug-in Aperture
7 Reflector Pan to Trim Ring Mounting Structure
8 Aperture Between Trim Ring Member and Reflector Pan Member
9 Spring Member
10 Reflector Cylinder Member
11 Rolled, Formed, or Added Top Edge Feature
12 Anti-rotation Feature of Reflector Cylinder Member
13 Element Clearance Notch
14 Sealing Plate
15 Sealing Plate Mounting Pin
16 Latch Member
17 Latch Mounting Pin
18 Electric Heating Element Coil Member
19 Electric Heating Element Base Member
20 Electric Heating Element Plug-in Member
21 Reflector Assembly for Gas Ranges
22 Gas Burner
23 Grate Member
24 Vertical Slot for Reflector Cylinder Member
25 Vertical Stop Feature
26 Recessed Area for Latch Mounting
27 Spring Mounting Feature
28 Cooking Vessel
29 Top Edge of Reflector Cylinder Member
30 Bottom Edge of Reflector Cylinder Member Construction Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

The invention is a cook-top reflector assembly featuring a spring-biased reflector cylinder member, which prevents heat from escaping laterally from under a cooking vessel being heated and reflects radiant heat energy towards the vessel. The energy-saving reflector assembly includes a housing member operatively associated with a heat source. A reflector cylinder member of selected diameter has an open top end with a top edge, an open bottom end with a bottom edge, and a cylindrical sidewall. The reflector cylinder member is biased mounted within the housing member and encircles the heat source operatively associated with the housing member. The top edge of the reflector cylinder member extends above the housing member and is adapted for encircling a cooking vessel of diameter less than the selected diameter of the cylinder member with the cooking vessel positioned within the reflector cylinder member. The top edge of the reflector cylinder member retracts into the housing member by contact with a cooking vessel of diameter at least equal to the selected diameter of the reflector cylinder member.

In a first embodiment of the invention, intended for electric cook-tops with plug-in elements, the reflector assembly replaces the standard reflector pan on each burner element. This embodiment of the invention is illustrated in FIGS. 1-4 and 9-13. The reflector cylinder assembly 2 comprises a trim ring member 3, which is fastened immovably to a bowl-shaped reflector pan member 4 by the reflector pan to trim ring mounting structures 7. The reflector pan member 4 has a concentric, horizontal reflector pan flange 5 on its upper edge. The mounting of the reflector pan member 4 to the trim ring member 3 by the reflector pan to trim ring mounting structures 7 creates a concentric cylindrical aperture 8 between the trim ring member 3 and the reflector pan member 4. A reflector cylinder member 10 slideably fits into the aperture 8 between the trim ring member 3 and the reflector pan member 4. Features 12 to prevent rotation of the reflector cylinder 10 are incorporated into the reflector cylinder member 10. For example, the anti-rotation features, in the form of tab portions 12, can be formed from the body of the reflector cylinder member 10 as shown, or added to the reflector cylinder member 10, as separate parts, such as pins or bosses. The anti-rotation features 12 slideably engage with the reflector pan to trim ring mounting structures 7 to prevent the reflector cylinder member 10 from rotating as it moves vertically. The anti-rotation features, such as tab portions 12, also act on the bottom of the trim ring member 3 to function as vertical stops for the reflector cylinder member 10. The reflector cylinder member 10 is biased to an upward position by spring members 9, which are of a strength that can be overcome easily by the weight of a lightweight cooking vessel 28. The spring members 9 are flat in cross-section and curved in profile. The spring members 9 are attached at one end to the reflector pan to trim ring mounting structure 7, such that the free end of the spring members 9 contact the lower edge 30 of the reflector cylinder member 10. The spring members 9 can be attached to the reflector pan to trim ring mounting structures 7 by welding, riveting, screwing or other fastening means. Alternatively, other spring types and mounting locations may also be used to bias the reflector cylinder member 10 with equivalent results. It is contemplated that alternatively, the reflector cylinder member 10 is biased by counter-weighted pivoting arms, with the end of the arms opposite the counterweights acting on the bottom edge 30 of the reflector cylinder member 10.

The reflector cylinder member 10 has an incorporated rolled, formed, or added edge feature 11 on its upper edge 29 that allows cooking vessels 28 to slide more easily over the top edge 29 of the reflector cylinder member 10. An element clearance notch 13 is incorporated into the lower edge 30 of the reflector cylinder member 10. When assembled to the trim ring member 3 and reflector pan member 4 assembly, the element clearance notch 13 is registered to align with the electric element plug-in aperture 6 that is incorporated in the reflector pan member 4. The element clearance notch 13 allows the reflector cylinder member 10 to travel downwardly, past the level of the electric heating element coil member 18. Covering the element clearance notch 13 is a slotted sealing plate 14, which is slideably mounted to the reflector cylinder member 10 by sealing plate mounting pins 15 or similar features. At the top of the range of travel of reflector cylinder member 10, the sealing plate 14 covers the element clearance notch 13 by the force of gravity. Spring biasing the sealing plate 14 in a lowered position is also an option. As the reflector cylinder member 10 is lowered, the sealing plate 14 contacts the electric heating element plug-in member 20 and slides upwardly, guided by its incorporated slots acting on the sealing plate mounting pins 15. The reflector cylinder member 10 can be held in a fully lowered position by quarter-turn latch members 16, which are mounted to the trim ring member 3 by latch mounting pins 17. Other latch arrangements that would perform the same function are contemplated. As on conventional reflector pan arrangements, the electric heating element base member 19 is supported by the reflector pan flange 5 of the reflector pan 4, while the electric heating element plug-in member 20 protrudes through the electric element plug-in aperture 6 of the reflector pan member 4 and the element clearance notch 13.

Figure 4:
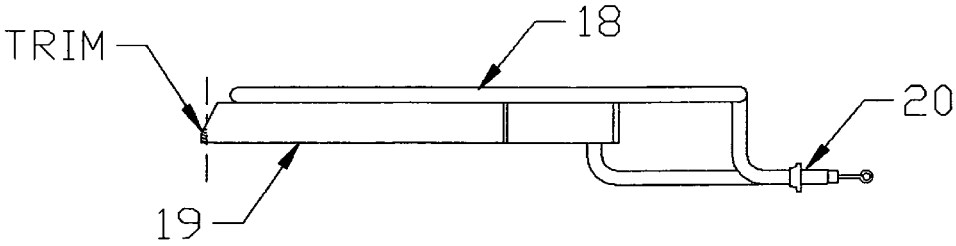
FIG. 4 is a side view of an electric range heating element assembly. This view illustrates how some electric range heating elements may be modified for use with the invention.
Figure 5:
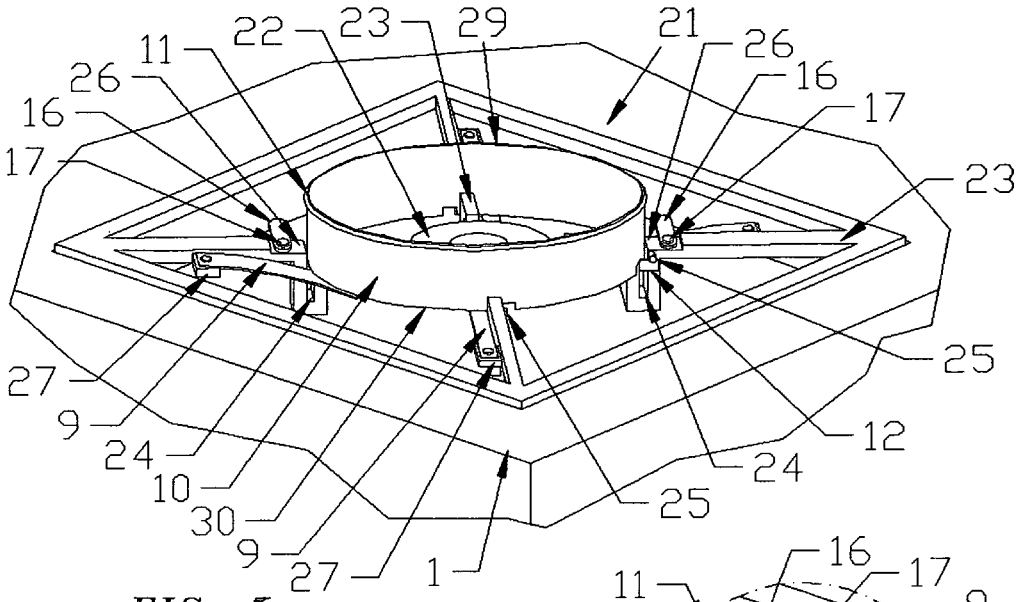
FIG. 5 is a perspective view of the gas range embodiment of the invention in place on a cook-top.
Figure 7:
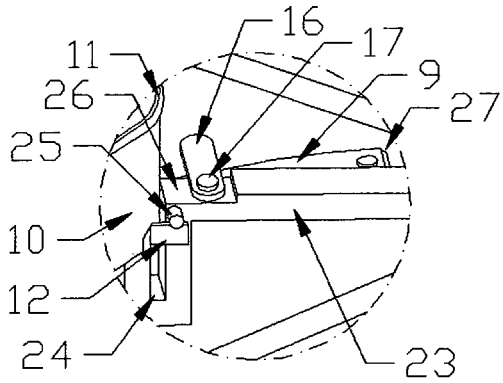
FIG. 7 is an enlarged perspective view of the reflector cylinder mounting and latch of the gas range embodiment of the invention. This view is taken from FIG. 6.
Figure 6:
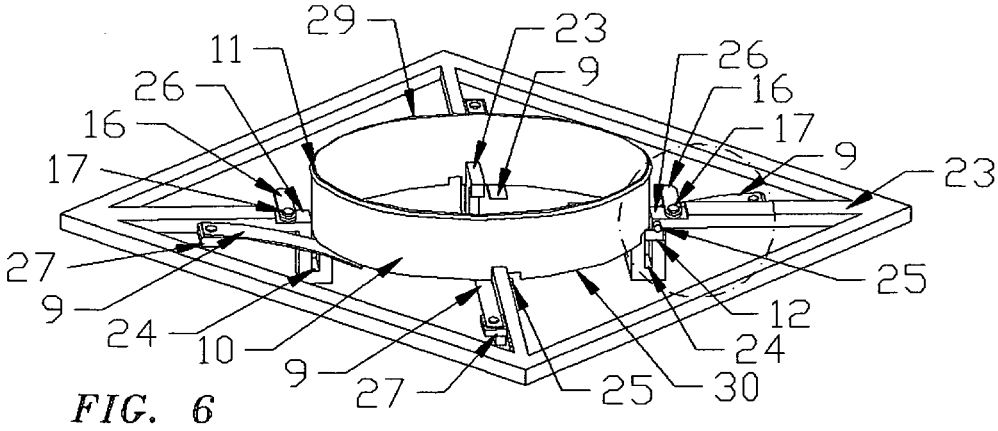
FIG. 6 is a perspective view of the gas range embodiment of the invention.
Figure 8:
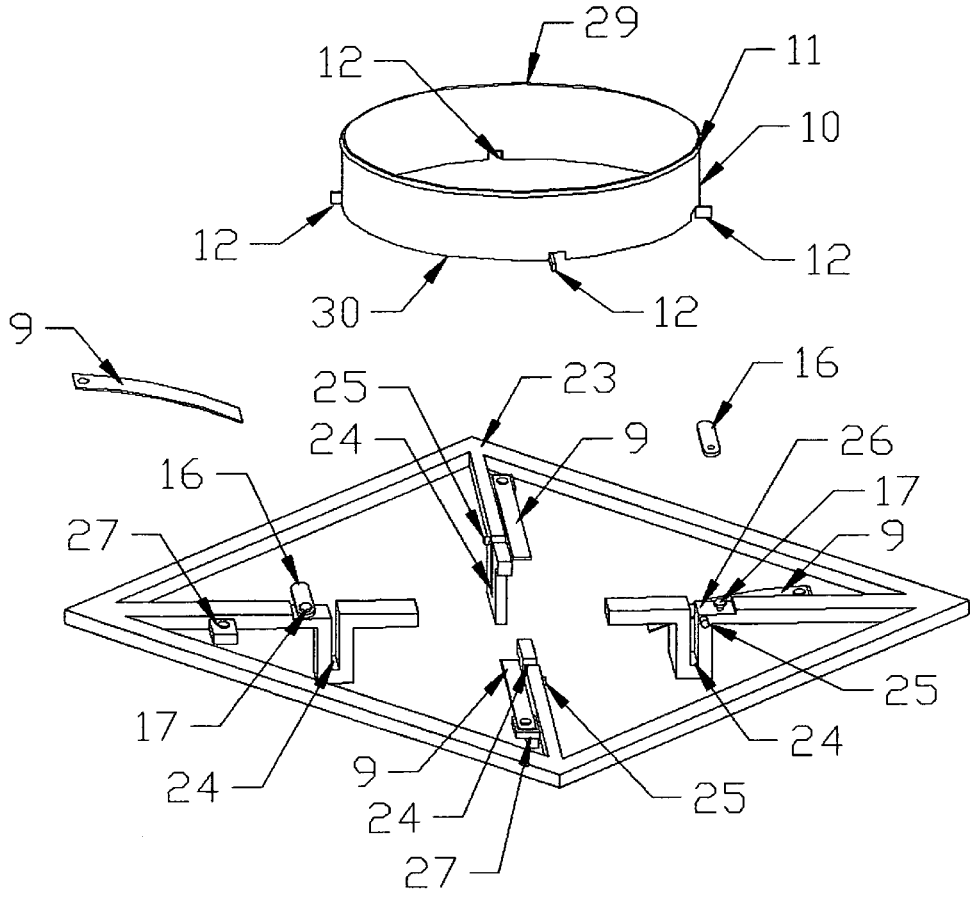
FIG. 8 is an exploded perspective view of the gas range embodiment of the invention.
Figure 9:
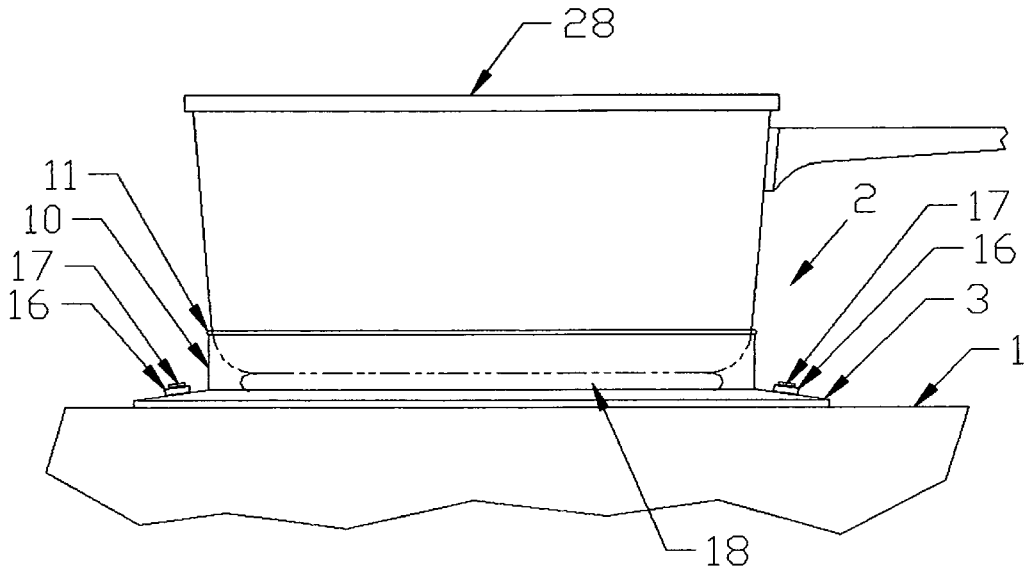
FIG. 9 is a front view of the invention in place on a cook top with a cooking vessel in place. Note that the cooking vessel is of the appropriate size for the electric heating element.
Figure 10:
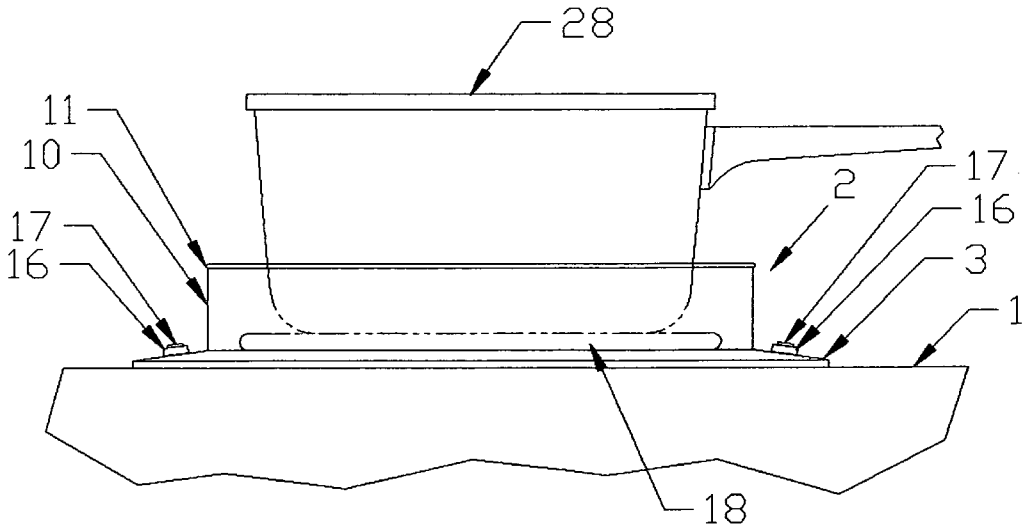
FIG. 10 is a front view of the invention in place on a cook top with a cooking vessel in place. Note that the cooking vessel is of a smaller size than optimal for the electric heating element.
Figure 11:
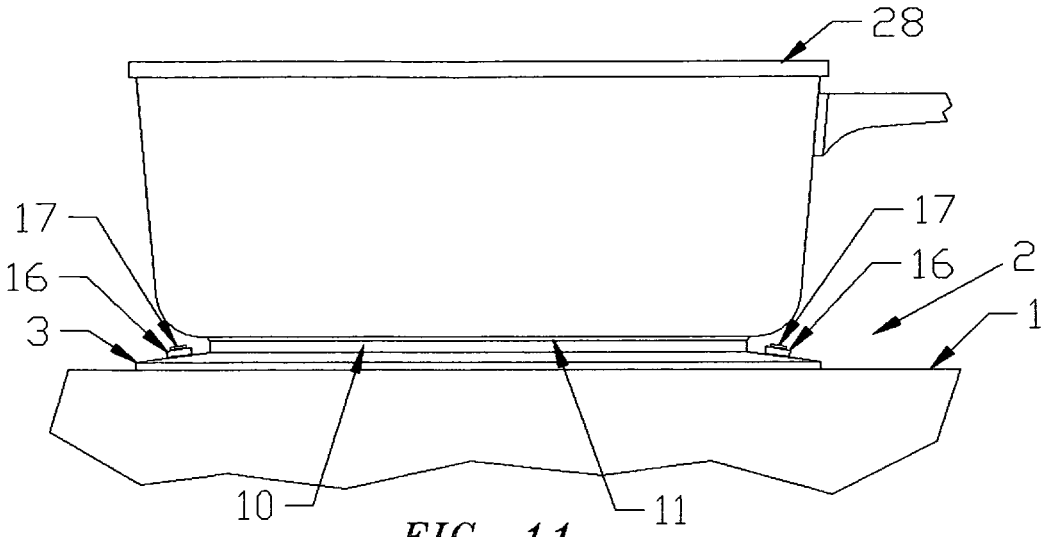
FIG. 11 is a front view of the invention in place on a cook top with a cooking vessel in place. Note that the cooking vessel is of a larger size than optimal for the electric heating element.
Figure 13:
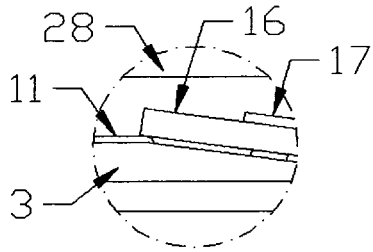
FIG. 13 is an enlarged detail view of a latch shown engaged to hold the reflector cylinder in the fully lowered position. This view is taken from FIG. 12.
Figure 12:
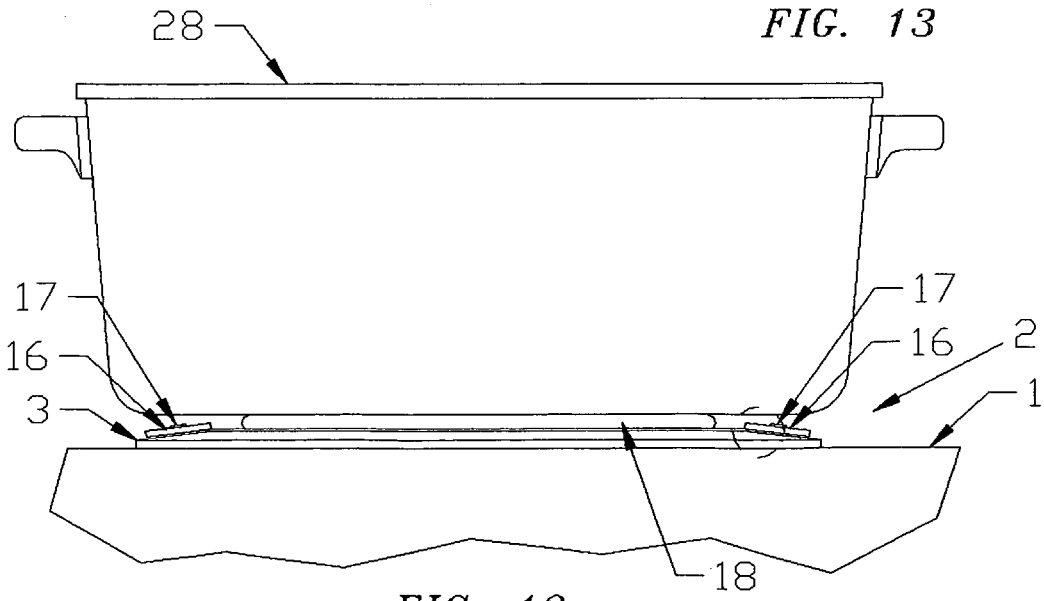
FIG. 12 is a front view of the invention in place on a cook top with a cooking vessel in place. Note that the cooking vessel is of much larger size than optimal for the electric heating element. In this view, the reflecting cylinder is latched into a fully lowered position.

On many cook-top models with plug-in electric elements, the reflector assembly 2 is a direct and simple replacement for the conventional reflector pan. On some other cook-top models, it may be necessary to trim the electric heating element base member 19 a nominal amount, as shown in FIG. 4. No other modifications are needed.

A second embodiment of the invention, for use on gas cook-tops, is illustrated in FIGS. 5-8. The gas range reflector assembly 21 is intended for direct and simple replacement of the standard gas range cook-top grate. In this embodiment, a grate member 23 is shaped to fit the particular model of cook-top, since there are many designs in production. The grate member 23 has incorporated vertical slots 24, which accept the reflector cylinder member 10. The reflector cylinder member 10 fits slideably into the grate's vertical slots 24. The reflector cylinder member 10 has incorporated features 12 to prevent rotation of the reflector cylinder 10. For example, the anti-rotation features, in the form of tab portions 12, can be formed from the body of the reflector cylinder member 10, as shown, or added to the reflector cylinder member 10 as separate parts, such as pins or bosses. The anti-rotation features 12 act slideably on the external sides of the vertical slots 24 incorporated into the grate member 23. The anti-rotation feature 12 also act on the vertical stop features 25 of the grate 23 to limit the vertical travel of the reflector cylinder member 10. For example, the stop features, in the form of pegs 25, protrude from the grate member 23 to engage the tabs 12 of the reflector cylinder member 10.

The reflector cylinder member 10 has an incorporated rolled, formed, or added edge feature 11 on its top edge 29 that allows cooking vessels 28 to slide more easily over the top of the reflector cylinder member 10. Spring mounting features 27 are incorporated into the grate member 23 structure to serve as a mounting point for spring members 9. The spring members 9 can be attached to the spring mounting features 27 by welding, riveting, screwing or other means. As in the first embodiment of the invention described above, the spring members 9 act on the bottom edge 30 of the reflector cylinder member 10 to bias it in an upward position. Recessed areas 26 for mounting latch members 16 are incorporated into the top surface of the grate member 23, so that quarter-turn latch members 16 may operate below the top surface of the grate member 23. As in the first embodiment of the invention, the latch members 16 operate by rotating on latch mounting pins 17 to latch the reflector cylinder member 10 in a fully retracted position, if desired.

While the invention has been particularly shown and described with reference to preferred embodiments thereof, it will be understood by those skilled in the art that various changes in form and details may be made therein without departing from the spirit and scope of the invention.

I claim:

1. An energy-saving reflector assembly adapted for improved heating of a cooking vessel by a heat source on a range cook-top comprising;

a housing member operatively associated with said heat source; and a reflector cylinder member of selected diameter having an open top end with a top edge, an open bottom end with a bottom edge, and a cylindrical sidewall, the reflector cylinder member biased mounted within the housing member and encircling said heat source operatively associated with the housing member;

the top edge of the reflector cylinder member extending above the housing member and adapted for encircling said cooking vessel of diameter less than the selected diameter of the cylinder member with said cooking vessel positioned within the reflector cylinder member;

the top edge of the reflector cylinder member retracting into the housing member by contact with said cooking vessel of diameter at least equal to the selected diameter of the reflector cylinder member.

2. The energy-saving reflector assembly, adapted for improved heating of a cooking vessel by a heat source on a range cook-top, according to claim 1, further including a plurality of latch members, pivotally secured to the housing member to secure the top edge of the reflector cylinder member within the housing member.

3. The energy-saving reflector assembly, adapted for improved heating of a cooking vessel by a heat source on a range cook-top, according to claim 1, wherein the top edge of the reflector cylinder member is rounded to allow unimpeded movement of said cooking vessel there over.

4. The energy-saving reflector assembly, adapted for improved heating of a cooking vessel by a heat source on a range cook-top, according to claim 1, wherein the housing member comprises a grate member operatively associated with a gas burner heat source, the grate member includes a plurality of vertical mounting slots housing the reflector cylinder member therein.

5. The energy-saving reflector assembly, adapted for improved heating of a cooking vessel by a heat source on a range cook-top, according to claim 4, wherein the reflector cylinder member is biased by a plurality of spring members, each attached between the grate member and the reflector cylinder member.

6. The energy-saving reflector assembly, adapted for improved heating of a cooking vessel by a heat source on a range cook-top, according to claim 4, further including a stop feature to limit upward vertical travel of the reflector cylinder member relative to the grate member.

7. The energy-saving reflector assembly, adapted for improved heating of a cooking vessel by a heat source on a range cook-top, according to claim 6, wherein the stop feature includes a plurality of tab portions extending from the reflector cylinder member and a peg member mounted on the grate member, the plurality of tab portions also functioning to limit rotation of the reflector cylinder member relative to the grate member.

8. The energy-saving reflector assembly, adapted for improved heating of a cooking vessel by a heat source on a range cook-top, according to claim 1, wherein the housing member comprises a trim ring member, rigidly fastened to a reflector pan member with a concentric circular aperture there between, the aperture housing the reflector cylinder member, the housing member operatively associated with an electrical heating element coil member heat source.

9. The energy-saving reflector assembly, adapted for improved heating of a cooking vessel by a heat source on a range cook-top, according to claim 8, wherein the reflector pan member includes an aperture, and the bottom edge of the reflector cylinder member includes a notch in register with said aperture, the notch and aperture adapted for connecting an electrical heating element coil member positioned within the reflector pan member to an electrical plug outside the reflector pan member.

10. The energy-saving reflector assembly, adapted for improved heating of a cooking vessel by a heat source on a range cook-top, according to claim 8, wherein the reflector cylinder member is biased by a plurality of spring members, each attached between housing member and the reflector cylinder member.

11. The energy-saving reflector assembly, adapted for improved heating of a cooking vessel by a heat source on a range cook-top, according to claim 8, further including a stop feature to limit upward vertical travel of the reflector cylinder member relative to the trim ring member.

12. The energy-saving reflector assembly, adapted for improved heating of a cooking vessel by a heat source on a range cook-top, according to claim 11, wherein the stop feature includes a plurality of tab portions extending from the reflector cylinder member that contacts the trim ring member, the plurality of tab portions also functioning to limit rotation of the reflector cylinder member relative to the trim ring member and attached reflector pan member.

13. The energy-saving reflector assembly, adapted for improved heating of a cooking vessel by a heat source on a range cook-top, according to claim 8, further including a plurality of latch members, pivotally secured to the housing member to secure the top edge of the reflector cylinder member within the housing member.

14. An energy-saving reflector assembly adapted for improved heating of a cooking vessel by a heat source on a range cook-top comprising;

a grate member operatively associated with a gas burner heat source, the grate member including a plurality of vertical mounting slots therein; and a reflector cylinder member of selected diameter having an open top end with a top edge, an open bottom end with a bottom edge, and a cylindrical sidewall, the reflector cylinder member biased mounted within the vertical slots of the grate member and encircling said gas burner heat source operatively associated with the grate member;

the top edge of the reflector cylinder member extending above the grate member and adapted for encircling said cooking vessel of diameter less than the selected diameter of the cylinder member with said cooking vessel positioned on the grate member, within the reflector cylinder member;

the top edge of the reflector cylinder member retracting into the grate member by contact with said cooking vessel of diameter at least equal to the selected diameter of the reflector cylinder member.

15. The energy-saving reflector assembly, adapted for improved heating of a cooking vessel by a heat source on a range cook-top, according to claim 14, wherein the reflector cylinder member is biased by a plurality of spring members, each attached between the grate member and the reflector cylinder member.

16. The energy-saving reflector assembly, adapted for improved heating of a cooking vessel by a heat source on a range cook-top, according to claim 14, further including a stop feature to limit upward vertical travel of the reflector cylinder member relative to the grate member, the stop feature including a plurality of tab portions extending from the reflector cylinder member and a peg member mounted on the grate member, the plurality of tab portions also functioning to limit rotation of the reflector cylinder member relative to the grate member.

17. An energy-saving reflector assembly adapted for improved heating of a cooking vessel by a heat source on a range cook-top comprising;

a housing member, including a trim ring member rigidly fastened to a reflector pan member with a concentric circular aperture there between, the housing member operatively associated with an electrical heating element coil member heat source; and a reflector cylinder member of selected diameter having an open top end with a top edge, an open bottom end with a bottom edge, and a cylindrical sidewall, the reflector cylinder member biased mounted within the concentric circular aperture of the housing member and encircling said electrical heating element coil member heat source operatively associated with the housing member;

the top edge of the reflector cylinder member extending above the housing member and adapted for encircling said cooking vessel of diameter less than the selected diameter of the cylinder member with said cooking vessel positioned within the reflector cylinder member;

the top edge of the reflector cylinder member retracting into the housing member by contact with said cooking vessel of diameter at least equal to the selected diameter of the reflector cylinder member.

18. The energy-saving reflector assembly, adapted for improved heating of a cooking vessel by a heat source on a range cook-top, according to claim 17, wherein the reflector pan member includes an aperture and the bottom edge of the reflector cylinder member includes a notch in register with said aperture, the notch and aperture adapted for connecting an electrical heating element coil member positioned within the reflector pan member to an electrical plug outside the reflector pan member.

19. The energy-saving reflector assembly, adapted for improved heating of a cooking vessel by a heat source on a range cook-top, according to claim 17, wherein the reflector cylinder member is biased by a plurality of spring members, each attached between the housing member and the reflector cylinder member.

20. The energy-saving reflector assembly, adapted for improved heating of a cooking vessel by a heat source on a range cook-top, according to claim 8, further including a stop feature to limit upward vertical travel of the reflector cylinder member relative to the trim ring member, the stop feature including a plurality of tab portions extending from the reflector cylinder member that contacts the trim ring member, the plurality of tab portions also functioning to limit rotation of the reflector cylinder member relative to the trim ring member and attached reflector pan member.

21. The energy-saving reflector assembly, adapted for improved heating of a cooking vessel by a heat source on a range cook-top, according to claim 17, further including a plurality of latch members, pivotally secured to the housing member to secure the top edge of the reflector cylinder member within the housing member.

* * * * *